United States Patent [19]

Vigo et al.

[11] Patent Number: 4,678,473

[45] Date of Patent: Jul. 7, 1987

[54] ARLYSULFONIUM CELLULOSIC FIBERS SUBSTANTIVE TO MANY DYE CLASSES

[75] Inventors: Tyrone L. Vigo, New Orleans; Eugene J. Blanchard, Metairie, both of La.

[73] Assignee: The United States of America as represented by the Secretary of Agriculture, Washington, D.C.

[21] Appl. No.: 903,173

[22] Filed: Sep. 3, 1986

[51] Int. Cl.[4] ..... D06M 13/28; G06P 5/22

[52] U.S. Cl. ..... 8/480; 8/115.7; 8/120; 8/481; 8/494; 8/529; 8/531; 8/532; 8/542; 8/543; 8/638; 8/921; 8/930

[58] Field of Search ..... 8/115.7, 120, 480, 481, 8/494, 529, 531, 532, 542, 543, 638, 921, 930

[56] References Cited

U.S. PATENT DOCUMENTS 3,698,857 10/1972 Vigo et al. .

4,563,189 1/1986 Lewis ..... 8/120

OTHER PUBLICATIONS

Sakamoto, et al., J. Appl. Poly. Sci., (1973).

*Chemical Abstracts* 93:169607.

*Primary Examiner*—James C. Cannon

*Attorney, Agent, or Firm*—M. Howard Silverstein; David G. McConnell; Raymond C. Von Bodungen

[57] ABSTRACT

Cellulosic fibers are converted to cellulosate by immersion in an alkali metal hydroxide and then reacted with an aqueous solution of thioarylsulfonium salts to produce modified cellulosic fibers which are substantive to acid, direct, disperse, reactive and sulfur dyes. Cellulosic/synthetic and cellulosic/wool blends can also be treated to produce a fabric blend comprising modified cellulosic components that are substantive to diverse dye classes and synthetic and wool components which are substantive to a single dye class. When using a disperse dyebath of one color the entire fabric blend is dyed one color. When adding an acid, reactive or sulfur dye of a second color to the dyebath, the synthetic or wool component is dyed one color and the cellulosic component is dyed a different color.

51 Claims, No Drawings

ARLYSULFONIUM CELLULOSIC FIBERS SUBSTANTIVE TO MANY DYE CLASSES

BACKGROUND OF THE INVENTION (1) Field of the Invention

This invention relates to processes for producing chemically modified cellulosic fibers substantive to dyes of several major classes.

(2) Description of the Prior Art

Cellulosic fibers, as with other fiber types, vary greatly in their affinity and substantivity (i.e., requiring or involving no mordant) for various classes of dyes. Cotton and other cellulosics, such as viscose rayon, are readily dyed by azoic, direct, reactive, sulfur and vat dyes, but normally do not have affinity for acid or for disperse dyes. Therefore, it was necessary to chemically modify cellulose by covalent bond formation to make it substantive to various dye classes. However, this only altered the cellulosic fiber's substantivity for one class of dyes. Examples of this technique would inlcude: (a) preparation of chlorodeoxycellulose and its subsequent reaction with primary amines, which is a modification of cotton to render it substantive to acid dyes (Vigo, et al., U.S. Pat. No. 3,698,857; 1972); (b) formation of cellulose $\beta$-mercaptethylaminocarboxylate and its subsequent reaction with methyl iodide to form an aliphatic sulfonium structure with improved affinity for direct dyes (M. Sakamoto, et al., *J. Appl. Poly. Sci.,* 1973); and (c) benzoylation of cotton cellulose to make the fiber substantive to disperse dyes (Shikishima Spinning Co.,Jpn. Kokao Tokkyo Koho No. 80 80,579; (1980). One disadvantage noted in two of the three examples described above, would be, such changes in dye substantivity are usually achieved by multistep reactions with cellulose. Another disadvantage noted in these approaches is that these modified celluloses generally have inferior colorfastness to washing.

SUMMARY OF THE INVENTION

Processes for producing cellulosic fibers which are substantive to diverse dye classes and the resultant products therefrom are disclosed. Cellulosic fibers are immersed into a solution of aqueous alkali metal hydroxide of sufficient concentration for sufficient time and temperature to convert the cellulosic fibers to alkali metal cellulosate which is then reacted with a sufficient amount of an aqueous solution of thioarylsulfonium salts of sufficient concentration and temperature for sufficient time to produce a modified cellulosic fiber which is substantive to dyes of diverse classes.

Thus, a modified cellulose fiber is produced by reaction of soda cellulose with an aqueous solution of thioarylsulfonium salts. The resultant modified cellulose (arylsulfonium or ARS cellulose) has sulfur contents of 0.1–1.6% attributable to a stable tetravalent sulfur structure (sulfurane) containing arylsulfonium groups. This modified ARS cellulose has affinity for dyes of diverse classes such as acid, direct, dispersed reactive and sulfur dyes and retains its enhanced dyeing properties even after laundering and acid or basic hydrolysis. This affinity for acid and disperse dyes are two dye classes that are not normally substantive to unsubstituted cellulosic fibers. Moreover, its successful application of the dyes is relatively independent of the pH of the dyebath in contrast to its importance to obtaining fiber affinity for certain dye classes, particularly reactive and acid dyes. ARS cellulosic fiber can be produced as the cellulosic component of a cellullosic-fiber/synthetic-fiber blend. Alternatively, a fabric blend can be woven comprising proteinaceous (such as wool) components or synthetic fiber components (such as polyester or nylon) with the modified ARS cellulosic fiber as the other component. Differential and crossdyeing effects of these fabric blends can be achieved with single or multiple dyebaths containing one or more different classes of dyes on fabrics derived from said ARS cellulosic fibers as part of the blend.

DESCRIPTION OF THE PREFERRED EMBODIMENTS

In the preferred embodiments, cellulosic-containing fibers can be immersed into aqueous metal hydroxides, such as sodium, lithium or potassium hydroxide of sufficient concentration to convert said cellulose to its sodium cellulosate form. The cellulose may exist in any form (fiber, sliver, yarn and/or fabric; native or regenerated) or may be part of a celluose-containing fiber blend. Wide ranges of time, temperature and concentration may be employed in the practice of this invention. Although 20–25% by wt. aqueous sodium hydroxide for 10–40 minutes immersion time for the cellulose in the alkaline solution at 20°–30° C. is preferred, 10–35% aqueous alkali metal hydroxide for 5–120 minutes at 15°–50° C. are acceptable ranges. Excess alkali is then usually removed from the fiber by conventional techniques such as centrifugation or squeeze rolls. This alkaline treatment of cellulose is essential for subsequent reaction of the cellulose with thioarylsulfonium salts to produce modified cellulosic fibers with improved dyeing characteristics.

This alkali-treated cellulose is then immersed in an aqueous solution of a mixture of thioarylsulfonium salts (such as that which can be commercially obtained from Southland Corporation, Great Meadows, N.J.). Although immersion of the alkali-treated cellulose in 1.0 to 10.0% by wt. of aqueous thioarylsulfonium salt solutions for 1 to 4 hours at 20° to 30° C. is preferred, immersion of the alkali treated cellulose in 0.5 to 20% by wt. of the thioarylsulfonium salt solutions for 0.25 to 24 hours at 10° to 50° C. are acceptable ranges. The thioarylsulfonium salts preferentially have chloride as the anion, and diphenyl-4-thiophenoxyphenylsulfonium and (thiodi-1,4-phenylene)bis[diphenyldisulfonium] as the cations.

This modified cellulosic fiber can then be washed in water to remove unreacted sulfonium salt, and dried and conditioned by conventional methods. Said modified cellulose, hereafter called arylsulfonium (ARS) cellulose, had weight gains of from about 3 to 15% after drying and conditioning, sulfur contents of from about 0.1 to 1.6%, and was stable to acid and alkaline hydrolysis with regard to retaining its novel and unique ability to be dyed by many major dye classes. More particularly, the ARS cellulose retained its improved dyeing characteristics, even after subjecting it to strong acid (1% HCl) and to strong base (1% NaOH) at temperatures of 25° to 60° C.

Stability of ARS cellulose and its sulfur content may be attributed to the formulation of a stable tetravalent sulfur structure, i.e., a sulfurane; $[RO]_2SR'_2$, wherein RO is cellulosate in the structures below:

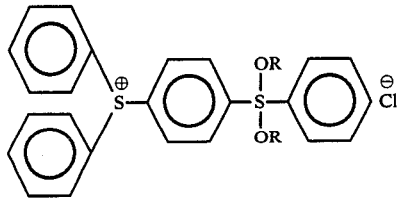

and

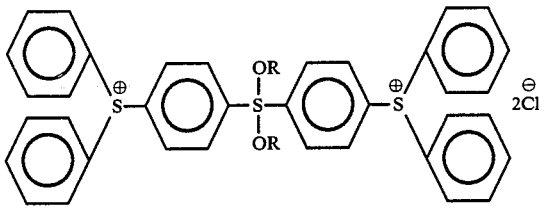

ARS cellulose has many distinct advantages over native and mercerized cotton with regard to its dyeability, such as: (1) substantially better affinity and substantivity for many major dye classes; (2) affinity that is essentially independent of the pH of the dyebath; (3) much greater dye uptake of direct and sulfur dyes; (4) better dye pickup of reactive dyes at acidic pH values (pH 5 or less). This means that ARS cellulose has a distinct advantage over unmodified celluloses because the latter require basic catalysis with reactive dyes to render them substantive to the fiber.

For dyes not normally substantive to cellulose, such as disperse and acid, ARS cellulose is far superior to unmodified cellulose fibers, as well as superior to synthetic fiber types (e.g, polyester) that have affinity for disperse dyes. Moreover, ARS cellulose has greater affinity for disperse dyes than does synthetic fibers when no carrier is used. It also has superior affinity for this class of dyes relative to unmodiifed cellulosic fibers. ARS cellulose is also comparable to or greater than wool in its affinity for acid dyes at pH greater than 5, and far superior to unmodified cellulose in its affinity for these dyes at wide pH ranges (e.g., pH 3 to 9)

Fabrics containing cellulosic/synthetic fiber blends, comprised of cotton/polyester or cotton/nylon, can be given an alkaline treatment and subsequently reacted with thioarylsulfonium salt solutions to produce a modified fabric in which the cellulosic component is converted to ARS cellulose. Alternatively, fabrics containing ARS cellulose as one component and synthetic fibers as the other component can be prepared by weaving, bonding and/or knitting ARS cellulosic yarns with yarns derived from synthetic fibers. Such types of blended fabrics (woven, nonwoven or knitted) can be subsequently dyed with a single class of dyes or with multiple dye classes in single or multiple dyebaths to achieve cross, and/or differential dyeing. Crossdyeing is defined as the dyeing of two different fibers or yarns in a fabric blend with multiple dyes so as to dye the fibers or yarns of one component one color and the fibers or yarns of the other component a different color. Differential dyeing is defined as the dyeing of two different fibers or yarns in a fabric blend with a single dye class or multiple dye classes of the same color to dye the fibers or yarns of one component one color and the fibers or yarns of the other component a lighter or darker shade of the same color.

More specifically, ARS cellulose/polyester fabric blends can be dyed with a disperse dyestuff to obtain solid shades. These fabric blends can also be dyed with multiple dyes in single or successive dyebaths to achieve cross, and/or differential dyeing effects. Such multiple dye class combinations include, but are not limited to: disperse/ acid, disperse/reactive, disperse/-sulfur or disperse/direct. ARS cellulose/nylon fabric blends can also be dyed with an acid dyestuff to obtain solid shades. These fabric blends can also be cross, and-/or differentially dyed to achieve multicolored effects. Such multiple dye class combinations include, but are not limited to: acid/direct, acid/sulfur or acid/reactive dyes. These dyeing effects can be obtained by either dyeing the fibers simultaneously or by utilizing multiple step dyeings. ARS cellulose/proteinaceous blends, such as ARS cotton/wool, can be prepared by a blend of the ARS cellulose with the protein-based fiber (wool) and can be dyed with an acid dye to produce solid shades. Such a cellulose/proteinaceous fiber blend can also be dyed with multiple dyes in single or successive dyebaths to achieve cross, and/or differential dyeing effects. Such multiple dye class combinations include, but are not limited to: acid/disperse, acid/direct, acid/reactive, and acid/sulfur. Again these novel dyeing effects can be obtained by either dyeing the fibers simulataneously or by utilizing multiple step dyeings.

Therefore, versatility of dyeing and effects thereof can be readily achieved with ARS cellulose/synthetic blends and ARS/cellulose/protein blends, whereas, such versatile dyeing effects are not attainable with unmodified cellulose blend combinations.

The preferred embodiments of the instant invention are demonstrated but not limited to the following examples:

EXAMPLE 1

Preparation of Arylsulfonium Cotton

Desized, scoured and bleached cotton printcloth was immersed in excess 23% aqueous sodium hydroxide (wt./wt. soln. for 30 min at 20° C. Excess alkali was removed from the fabric by use of squeeze rolls at 50 lb. pressure to attain a wet wt. of 150% (relative to dried and conditioned fabric). The wet fabric was immersed without agitation in a 5% aq. mixture of diphenyl-4-thiophenoxyphenylsulfonium chloride and (thiodi-1,4-phenylene)bis[diphenylsulfonium] dichloride for 2.5 hr. at 20° C., washed first with water for 15 min., then machine-washed and dried. The bath ratio was 40 g of sulfonium soln./g based on initial wt. of dried and conditioned fabric. Although the resultant ARS cotton fabric had a wt. gain of 5.0% and a sulfur content (determined by x-ray fluorescence) of 0.50%, other wt. gains and sulfur contents were obtained by varying sulfonium salt concentration and reaction time. For example, wt. gains of 6.2 and 10.2 % and corresponding % S contents of 0.8 and 1.2%, respectively, were obtained when the alkali-wet cotton fabric (as prepared above) was immersed in 2% and 5% aqueous solution of the arylsulfonium salts for 20 hr.

EXAMPLE 2

Effect of Dyeing ARS Cotton with Acid Dyes

Samples of ARS cotton (wt. gain of 7.3%) and untreated cotton printcloth were immersed together in an acid dye bath (pH 9) containing 20% Kiton Fast Red 3GLL (based on fabric wt. at a liquor/fabric ratio of 40/1. These samples were boiled for 15 min. in the dyebath, washed for 10 min. with water, boiled in water for 10 min, then washed for an additional 5 min in water to remove excess dye, and allowed to air dry.

Results showed that the ARS cotton was dyed a deep red shade (K/S value of 0.2116 or % reflectance value of 52.7) in contrast to the untreated cotton that was only tinted by the acid dye (K/S value of 0.0041 or % reflectance value of 90.7). Comparable shades of red were attained even after the ARS cotton was subjected to acid (1% HCl) or alkali (1% NaOH) for 15 min. at 50° C. for 15 min, washed, dried, and then dyed. Reflectance values of 58.8 and 55.8%, respectively for ARS cotton fabrics previously subjected to acid and base hydrolysis) were obtained.

EXAMPLE 3

Effect of Dyeing ARS Cotton with Direct Dyes

A sample of ARS cotton (derived from reaction with 2% arylsulfonium salt soln. for 20 hr.) and samples of untreated and mercerized (washed and dried) fabrics were dyed together with direct dyes, utilizing 5% C. I. Direct Blue 78 (pH of 5) of wt. of fabric. All fabrics were dyed in boiling water for 20 min. (liquor/fabric ratio 40/1), washed, boiled in water, and washed again as in Example 2. All three samples had substantivity to direct dyes, but the ARS cotton dyed a deep shade of blue whereas the mercerized and untreated cotton control fabrics dyed light shades of blue. Corresponding % reflectance values were 4.6 for ARS cotton, 15.0 for mercerized cotton, and 26.3 for untreated cotton.

EXAMPLE 4

Effect of Dyeing ARS Cotton with Reactive Dyes

Samples of the three fabrics as described in Example 3 (ARS cotton, mercerized and untreated cotton controls) were dyed together with Reactive Blue 109 at pH 5 and at 5% of wt. of fabric (liquor/fabric ratio 40/1) for 20 min. and then washed, boiled in water, and washed again as in Example 2. The ARS cotton dyed a very deep shade of blue, whereas mercerized and untreated cotton produced much lighter shades of blue. Corresponding % reflectance values were 5.9 for ARS cotton, 76.7 for mercerized cotton and 82.4 for untreated cotton.

EXAMPLE 5

Effect of Dyeing ARS Cotton with Sulfur Dyes

Samples of the three fabrics (as described in Example 3) were dyed together with Sulfur Red 14 at a pH of 5 and at 20% of wt. of fabric (liquor/fabric ratio 40/1) for 20 min, and washed, boiled in water, and washed again as in Example 2. Dyed ARS cotton produced a deep red shade in contrast to much lighter shades for the mercerized and untreated cotton samples. Corresponding % reflectance values were 46.4 for ARS cotton, 87.6 for mercerized cotton, and 89.5 for untreated cotton.

EXAMPLE 6

Effect of Dyeing ARS Cotton with Disperse Dyes

Samples of the three fabrics (as described in Example 3) were dyed together with Disperse Red 5 at a pH of 5 (10% by wt. of fabric and a liquor/fabric ratio of 40/1) for 20 min, washed, boiled in water, and washed again as in Example 2. ARS cotton had a much deeper shade of red than the mercerized and untreated cotton. Corresponding % reflectance values were 20.5 for ARS cotton, 76.0 for mercerized cotton, and 77.4 for untreated cotton.

EXAMPLE 7

Effect of Dyeing of Cotton and Polyester Fabrics with Disperse and Reactive Dyes A sample of ARS cotton (treated as in Example 1) and a sample of uhtreated polyester fabric were dyed together in a dyebath (pH 5.0) comprised of: 5% Disperse Yellow 3; 5% Reactive Red 2; and 5% biphenyl carrier (based on fabric weight). Samples were dyed at a liquor to fabric ratio of 40:1 for 20 min. at 100° C. After rinsing and washing (as described in Example 2), results showed that the polyester dyed yellow and the ARS cotton dyed red. This shows that cotton and polyester fabrics can be crossdyed together to produce different colored fabrics utilizing disperse and reactive dyes without having to affix the reactive dye under basic conditions. Fabric blends containing ARS cotton and other synthetic fiber yarns with affinity for disperse dyestuffs can also be crossdyed by the same procedure.

EXAMPLE 8

Effect of Dyeing of Cotton and Polyester Fabric with Disperse Dyes

Samples of ARS cotton and polyester fabric were treated and dyed as in Example 7, except the fabric samples were dyed together only with Disperse Red 5. After rinsing and washing (as in Example 2), the polyester and cotton samples were both dyed a deep reddish color, indicating that both fibers had comparable affinity for disperse dyes. This shows that ARS cotton and polyester fabric can be dyed together with disperse dyes to produce a dyed fabric of the same color.

EXAMPLE 9

Effect of Dyeing of Cotton/Polyester Check Fabric with Disperse and Reactive Dyes A sample of cotton/polyester woven check fabric composed of 1/2 inch squares of cotton and polyester yarns was treated as in Example 1. The treated sample was then dyed as in Example 7. After rinsing and washing as in Example 2, results showed the cotton component dyed red and the polyester component dyed yellow. This shows that a cotton/polyester fabric blend can be treated as in Example 1 to convert the cotton component to ARS cotton and the resulting fabric blend can be dyed with two different dye classes to obtain a crossdyed fabric of two different colors.

EXAMPLE 10

Effect of Dyeing ARS Cotton Cellulose with Disperse Dyes

A sample of cotton/polyester woven check fabric was treated and dyed as in Example 9, except that Kiton Fast Red 3 GLL acid dye was used in place of Reactive Red 2 after rinsing and washing as described in Example 2. Results showed the cotton component dyed red and the polyester component dyed yellow. This shows that a cotton/polyester fabric blend can be dyed simultaneously with disperse and acid dyes to obtain a crossdyed fabric of two different colors.

EXAMPLE 11

Effect of Crossdyeing with Disperse Yellow 3 and Reactive Red 2 of Fabric Prepared from ARS Cotton and Polyester Yarns Cotton yarns was treated as was cotton printcloth in Example 1 to produce ARS cotton yarn. A plain jersey knitted fabric blend was produced by alternating ARS cotton and polyester yarns. The jersey was then dyed in a bath containing Disperse Yellow 3 and Reactive Red 2 as in Example 7. After rinsing and washing as in Example 2 results showed the cotton component of the jersey dyed red and the polyester component of the jersey dyed yellow to give a crossdyed jersey of two different colors.

EXAMPLE 12

Effect of Dyeing with Kiton Fast Red 3 GLL Acid Dye of Fabric Prepared from ARS Cotton and Wool Yarns Cotton yarn was treated as in Example 1 to produce ARS cotton. A plain jersey composed of blended yarns was produced by alternating ARS cotton and wool yarns. The fabric was then dyed with acid dye Kiton Fast Red 3 GLL as in Example 3 except at a pH of 3. This produced a fabric that dyed red. Results show that a cotton/wool fabric blend can be dyed with one dye class (acid dyes) to obtain a solid shade.

We claim:

1. A process for producing cellulosic fibers which are substantive to diverse dye classes comprising:

(a) immersing cellulosic fibers into a solution of aqueous alkali metal hydroxide of sufficient concentration for sufficient time and temperature to convert the cellulosic fibers to alkali metal cellulosate; then, (b) reacting the alkali cellulosic fiber with a sufficient amount of an aqueous solution of thioarylsulfonium salts of sufficient concentration and temperature for sufficient time to produce a modified cellulosic fiber which is substantive to dyes of diverse classes.

2. The process of claim 1 wherein the cellulosic fibers are selected from the group consisting of: cotton, rayon, and linen.

3. The process of claim 1 wherein the alkali is selected from the group consisting of: NaOH, LiOH and KOH.

4. The process of claim 1 wherein the cellulosic fibers are immersed in an aqueous alkali metal hydroxide solution of from about 10 to 35 percent by weight, for from about 5 to 120 minutes at from about 15° to 50° C.

5. The process of claim 1 wherein the aqueous solution of thioarylsulfonium salts is of from about 0.5 to 20 percent by weight for from about 0.25 to 24 hours at from about 10° to 50° C.

6. The process of claim 1 wherein cellulosic fibers are immersed in an aqueous solution of from about 20 to 25 percent by weight of sodium hydroxide at from about 20° to 30° C. for from about 10 to 40 minutes.

7. The process of claim 1 including washing the product of (b) with sufficient amounts of water to remove the unreacted material from the cellulosic fibers.

8. A modified cellulosic fiber which is substantive to dyes of diverse classes as produced in accordance with the process of claim 1.

9. The process of claim 7 wherein the modified cellulosic fibers are then immersed in a dye bath of sufficient concentration for sufficient time and temperature to produce dyed cellulosic fibers.

10. A modified cellulose fiber which is substantive to dyes of diverse classes as produced in accordance with the process of claim 7.

11. The process of claim 9 wherein the dye in the dyebath is selected from the group consisting of: acid dyes, disperse dyes, reactive dyes, direct dyes and sulfur dyes.

12. A dyed cellulosic fiber as produced in accordance with the process of claim 9.

13. A modified cellulosic fiber which is substantive to diverse classes of dyes said fiber characterized by covalently bonded thioarylsulfonium salts with a cellulosic fiber substrate.

14. A modified cellulosic dyed fiber which is substantive to diverse classes of dyes said dyed fiber characterized by covalently bonded thioarylsulfonium salts with a cellulosic fiber substrate.

15. A process for producing a fabric blend which is substantive to diverse dye classes comprising:

(a) immersing a fabric blend comprising cellulosic and synthetic components into a solution of aqueous alkali metal hydroxide of sufficient concentration for sufficient time and temperature to convert the cellulosic fibers to alkali metal cellulosate; and then, (b) reacting the fabric blend with a sufficient amount of an aqueous solution of thioarylsulfonium salts of sufficient concentration and temperature for sufficient time to produce a fabric which has modified cellulosic components which are substantive to dyes of diverse classes and synthetic fiber components which are substantive to a single dye class.

16. The process of claim 15 wherein the cellulosic fibers are selected from the group consisting of: cotton, rayon, and linen and the synthetic fibers are selected from the group consisting of polyester and nylon.

17. The process of claim 15 wherein the alkali is selected from the group consisting of: NaOH, LiOH and KOH.

18. The process of claim 15 wherein the aqueous solution of thioarylsulfonium salts is of from about 0.5 to 20% by wt. at from about 10° to 50° C. for from about 0.25 to 24 hours.

19. The process of claim 15 wherein the fabric blend is immersed in an aqueous alkali metal hydroxide solution of from about 10 to 35 percent by weight, for from about 5 to 120 minutes at from about 15° to 50° C.

20. The process of claim 15 wherein the fabric blend is immersed in an aqueous solution of from about 20 to 25 percent by weight of sodium hydroxide at from about 20° to 30° C. for from about 10 to 40 minutes.

21. The process of claim 15 including washing the product of step (b) with sufficient amounts of water to remove the unreacted material from the fabric.

22. A fabric blend comprising modified cellulosic components which are substantive to dyes of diverse classes and synthetic fiber components which are substantive to a single dye class as produced in accordance with the process of claim 15.

23. A fabric blend comprising modified cellulosic components which are substantive to dyes of diverse classes and synthetic fiber components which are substantive to dyes of a single dye class as produced in accordance with the process of claim 20.

24. A fabric blend comprising modified cellulosic components which are substantive to dyes of diverse classes and synthetic fiber components which are substantive to a single dye class as produced in accordance with the process of claim 21.

25. The process of claim 21 wherein the fabric blend is then immersed in a dye bath of sufficient concentration for sufficient time and temperature to produce a dyed fabric blend.

26. A dyed fabric blend comprising modified cellulosic components which are substantive to dyes of diverse classes and synthetic fiber components which are substantive to a single dye class as produced in accordance with the process of claim 25.

27. The process of claim 25 wherein the dye in the dyebath is a disperse dye and both the cellulosic and synthetic components in the fabric blend are dyed the same color after immersion in said dyebath.

28. The process of claim 25 wherein the dye in the dyebath is composed of a disperse dye of one color and a dye of a second color which is selected from the group consisting of: acid, direct, reactive and sulfur dyes, thereby producing a dyed fabric blend wherein the synthetic component is dyed one color by the disperse dye and the modified cellulosic component is dyed a second color by the dye which is selected from the group consisting of acid, direct, reactive and sulfur dyes.

29. A dyed fabric blend comprising modified cellulosic components which are substantive to dyes of diverse classes and synthetic fiber components which are substantive to a single dye class as produced in accordance with the process of claim 27.

30. A dyed fabric blend comprising modified cellulosic components which are substantive to dyes of diverse classes and synthetic fiber components which are substantive to a single dye class as produced in accordance with the process of claim 28.

31. A process for producing a woven, nonwoven or knitted fabric blend which is substantive to diverse dye classes comprising:

(a) immersing cellulosic fiber into a solution of aqueous alkali metal hydroxide of sufficient concentration for sufficient time and temperature to convert the cellulosic fibers to alkali metal cellulosate;

(b) reacting the alkali cellulosic fiber with a sufficient amount of an aqueous solution of thioarylsulfonium salts of sufficient concentration and temperature for sufficient time to produce a modified cellulosic fiber which is substantive to dyes of diverse classes;

(c) washing, drying, and then weaving, bonding or knitting said modified cellulosic fiber with synthetic fiber to produce a woven, bonded or knitted fabric blend which has modified cellulosic components which are substantive to dyes of diverse classes and synthetic components which are substantive to a single dye class.

32. The process of claim 31 wherein the cellulosic fiber is selected from the group consisting of: cotton, rayon, and linen and the synthetic fiber is selected from the group consisting of: polyester and nylon.

33. The process of claim 31 wherein the alkali is selected from the group consisting of: NaOH, LiOH and KOH.

34. The process of claim 31 wherein the aqueous solution of thioarylsulfonium salts is from about 0.5 to 20% by wt. at from about 10° to 50° C. for from about 0.25 to 24 hours.

35. The process of claim 31 wherein the woven, bonded or knitted fabric blend is immersed in an aqueous alkali metal hydroxide solution of from about 10 to 35 percent by weight, for from about 5 to 120 minutes at from about 15° to 50° C.

36. A woven, bonded or knitted fabric blend which has modified cellulosic components which are substantive to dyes of diverse classes and synthetic components which are substantive to a single dye class produced in accordance with the process of claim 31.

37. The process of claim 35 wherein the woven, bonded or knitted fabric blend is then immersed in a dye bath of sufficient concentration for sufficient time and temperature to produce a dyed fabric blend.

38. The process of claim 37 wherein the dye in the dyebath is a dispersed dye and both the cellulosic and synthetic components in the fabric blend are dyed the same color after immersion in the dyebath.

39. The process of claim 37 wherein the dye in the dyebath is composed of a disperse dye of one color and a dye of a second color which is selected from the group consisting of: acid, direct, reactive and sulfur dyes, thereby producing a dyed fabric blend wherein the synthetic component is dyed one color by the disperse dye and the modified cellulosic component is dyed a second color by the dye which is selected from the group consisting of acid, direct, reactive and sulfur dyes.

40. A process for producing a woven or knitted fabric blend which is substantive to diverse dye classes comprising:

(a) immersing cellulosic fiber into a solution of aqueous alkali metal hydroxide of sufficient concentration for sufficient time and temperature to convert the cellulosic fibers to alkali metal cellulosate;

(b) reacting the alkali cellulosic fiber with a sufficient amount of an aqueous solution of thioarylsulfonium salts of sufficient concentration and temperature for sufficient time to produce a modified cellulosic fiber which is substantive to dyes of diverse classes;

(c) washing, drying and then weaving or knitting said modified cellulosic fiber with wool fiber to produce a fabric blend which has modified cellulosic components that are substantive to dyes of diverse classes and wool components that are substantive to a single dye class.

41. The process of claim 40 wherein the cellulosic-wool fabric blend is then immersed in a dye bath of sufficient concentration for sufficient time and temperature to produce a dyed cellulosic-wool blend fabric.

42. The process of claim 41 wherein the dye in the dyebath is an acid dye to produce a cellulosic-wool blend fabric of a single color.

43. The process of claim 41 wherein the dye in the dyebath is composed of an acid dye of one color and a dye of a second color which is selected from the group consisting of direct, reactive, disperse and sulfur dyes, thereby producing a dyed cellulosic-wool fabric blend wherein the wool component is dyed one color by the acid dye and the modified cellulosic.component is dyed a different color by the dye which is selected from the group consisting of direct, reactive, sulfur and disperse dyes.

44. The process of claim 41 wherein the dye in the dyebath is an acid dye to produce a cellulosic-wool blend fabric of a single color.

45. A dyed cellulosic-wool blend fabric produced in accordance with the process of claim 42.

46. A dyed cellulosic-wool fabric blend produced in accordance with the process of claim 43.

47. A fabric blend comprising modified cellulosic components which are substantive to diverse classes of dyes and synthetic fiber components which are substantive to a single dye class said fabric blend characterized by covalently bonded thioarylsulfonium salts with a cellulosic fiber substrate which is blended with synthetic components.

48. A single color dyed cellulosic-synthetic fabric blend, said dyed cellulosic-synthetic fabric blend characterized by covalently bonded thioarylsulfonium salts with a cellulosic fiber substrate which is blended with synthetic fiber components in which both cellulosic and synthetic components are attached to dyes of diverse classes.

49. A multicolor cellulosic-synthetic dyed fabric blend, said dyed cellulosic-synthetic fabric blend characterized by a synthetic fiber component attached to a disperse dye of one color that is blended with a cellulosic fiber substrate with covalently bonded thioarylsulfonium salts component attached to a dye of a different color which is selected from the group consisting of acid, direct, reactive and sulfur dyes.

50. A single color dyed cellulosic-wool fabric blend, said dyed cellulosic-wool fabric blend characterized by covalently bonded thioarylsulfonium salts with a cellulosic fiber substrate which is blended with wool fiber components in which both cellulosic and wool components are attached to an acid dye.

51. A multicolor dyed fabric cellulosic-wool blend said dyed cellulosic-wool fabric blend characterized by a wool component atttached to an acid dye of one color that is blended with a cellulosic fiber substrate with covalently bonded thioarylsulfonium salts attached to a dye of a different color, which is selected from the group consisting of direct, rective, disperse, and sulfur dyes.

* * * * *